US009850059B2

(12) United States Patent
Corney

(10) Patent No.: US 9,850,059 B2
(45) Date of Patent: Dec. 26, 2017

(54) CLOSED SYSTEM FOR VENTING A DISPENSER RESERVOIR

(71) Applicant: GOJO Industries, Inc, Akron, OH (US)

(72) Inventor: Richard E. Corney, Akron, OH (US)

(73) Assignee: GOJO INDUSTRIES, INC, Akron, OH (US)

( * ) Notice: Subject to any disclaimer, the term of this patent is extended or adjusted under 35 U.S.C. 154(b) by 170 days.

(21) Appl. No.: 14/658,287

(22) Filed: Mar. 16, 2015

(65) Prior Publication Data

US 2015/0266657 A1 Sep. 24, 2015

Related U.S. Application Data

(60) Provisional application No. 61/968,058, filed on Mar. 20, 2014.

(51) Int. Cl.

| | |
|---|---|
| ***B67D 7/78*** | (2010.01) |
| ***B65D 83/28*** | (2006.01) |
| ***B65D 47/06*** | (2006.01) |
| ***A47K 5/12*** | (2006.01) |
| ***B65D 51/24*** | (2006.01) |
| ***B05B 11/00*** | (2006.01) |
| *B05B 1/28* | (2006.01) |

(52) U.S. Cl.

CPC ..... *B65D 83/28* (2013.01); *A47K 5/1207* (2013.01); *B05B 11/0016* (2013.01); *B05B 11/0043* (2013.01); *B65D 47/06* (2013.01); *B65D 51/245* (2013.01); *B05B 1/28* (2013.01)

(58) Field of Classification Search

CPC ..... A47K 5/1207; B05B 1/28; B05B 11/0016; B05B 11/0046; B65D 47/06; B65D 81/245; B65D 83/28

USPC ..... 222/130, 181.1, 186, 320, 321.1, 321.7, 222/321.8, 386.5, 387, 389, 400.7, 478

See application file for complete search history.

(56) References Cited

U.S. PATENT DOCUMENTS

| | | | | |
|---|---|---|---|---|
| 17,073 A * | 4/1857 | Boyd | B65F 83/62 | 222/386.5 |
| 209,244 A * | 10/1878 | Gaffron | B65D 83/62 | 220/259.1 |
| 338,958 A * | 3/1886 | Hanlon | B65D 83/0005 | 222/387 |

(Continued)

FOREIGN PATENT DOCUMENTS

| | | |
|---|---|---|
| FR | 2781768 A1 | 2/2000 |
| WO | 00/24444 A1 | 5/2000 |

*Primary Examiner* — Patrick M Buechner
*Assistant Examiner* — Michael J Melaragno
(74) *Attorney, Agent, or Firm* — Calfee, Halter & Griswold LLP

(57) ABSTRACT

A fluid product reservoir, for a dispensing system, is made of a container having walls that include an aperture formed at one end thereof. A reservoir cap seals the aperture from exposure to the atmosphere. A pump integrated into the reservoir cap allows fluid product to be dispensed from the dispensing system. A closed venting mechanism is included and incorporates one or more air channels that direct ambient air into a bladder positioned internal to the fluid product reservoir. The expansion of the bladder functions to displace fluid pumped from the reservoir thereby equalizing pressure while maintaining a sanitary seal of the fluid reservoir.

20 Claims, 5 Drawing Sheets

(56) References Cited

U.S. PATENT DOCUMENTS 642,960 A * 2/1900 Clibborn ..... B65D 83/62 222/386.5
2,286,797 A * 6/1942 Duerme ..... A61J 11/02 215/11.3
2,343,847 A * 3/1944 Swann ..... G01F 11/32 222/440
2,513,455 A * 7/1950 Cornelius ..... B05B 9/047 138/30
2,554,570 A * 5/1951 Harvey ..... G01F 11/08 222/207
2,649,995 A * 8/1953 Nathan ..... A23G 9/28 222/105
2,815,152 A * 12/1957 Mills ..... B65D 83/62 220/720
3,215,319 A * 11/1965 Laker ..... B65D 35/22 222/209
3,235,137 A * 2/1966 Thomas ..... B65D 83/62 222/263
3,319,837 A * 5/1967 Mueller ..... B05B 11/004 215/382
3,409,714 A * 11/1968 Strugar, Jr. ..... B60K 15/03 222/105
3,592,360 A * 7/1971 Aleck ..... B65D 88/62 138/30
3,592,365 A * 7/1971 Schwartzman .... B65D 83/0055 222/209
3,945,062 A * 3/1976 Corsette ..... E03D 9/037 222/373
3,998,359 A * 12/1976 Pettit ..... B64G 1/50 222/3
4,120,425 A * 10/1978 Bethurum ..... B67D 1/1234 222/146.6
4,239,132 A * 12/1980 Mueller ..... B05B 11/004 215/11.3
4,361,257 A * 11/1982 Stone, Jr. ..... A47G 19/14 222/464.1
4,420,100 A * 12/1983 Mueller ..... B05B 11/004 215/11.3
4,723,688 A * 2/1988 Munoz ..... B67D 3/0009 165/140
4,881,666 A * 11/1989 Tullman ..... B65D 23/00 222/105
5,209,377 A * 5/1993 Steiner ..... A47K 5/1209 222/189.09
5,232,126 A * 8/1993 Winer ..... B65D 83/0061 222/386.5
5,242,085 A * 9/1993 Richter ..... B65D 1/0215 215/12.1
5,344,045 A * 9/1994 Richter ..... B65D 1/0215 215/12.2
5,433,346 A * 7/1995 Howe ..... B65D 77/06 222/105
5,487,490 A * 1/1996 Estes ..... B65D 47/2031 222/1
5,772,079 A * 6/1998 Gueret ..... B05B 11/0024 222/256
5,975,360 A * 11/1999 Ophardt ..... A47K 5/1205 222/181.1
6,062,430 A * 5/2000 Fuchs ..... B05B 11/004 222/105
6,345,739 B1 * 2/2002 Mekata ..... B65D 83/64 141/20
6,502,725 B1 * 1/2003 Alexander ..... B67D 1/0456 222/105
7,150,376 B2 * 12/2006 Tsai ..... B65D 83/0055 137/533.19
7,267,251 B2 * 9/2007 Ophardt ..... A47K 5/1207 222/181.1
7,367,479 B2 * 5/2008 Sitz ..... B65D 81/2053 222/400.7
7,770,762 B2 * 8/2010 Arghyris ..... B05B 11/0018 215/11.3
7,798,371 B2 * 9/2010 Ophardt ..... A47K 5/1207 222/181.3
8,074,839 B2 * 12/2011 Ronsin ..... A45D 34/02 215/12.2
8,272,539 B2 * 9/2012 Ophardt ..... A47K 5/14 222/181.1
8,360,286 B2 * 1/2013 Shi ..... A47K 5/1207 222/181.3
8,397,951 B2 * 3/2013 Moretti ..... B05B 11/0043 222/105
8,408,426 B2 * 4/2013 Bakhos ..... B65D 47/2018 222/105
8,464,908 B1 * 6/2013 Tabor ..... B65D 51/1644 222/105
8,561,853 B2 * 10/2013 De Mei ..... B65D 79/005 222/153.04
8,678,240 B2 * 3/2014 O'Brien ..... A47K 5/1207 222/181.3
8,733,596 B2 * 5/2014 Ophardt ..... A47K 5/1204 222/145.5
8,905,265 B2 * 12/2014 Muderlak ..... A47K 5/1207 222/181.3
2003/0029889 A1 * 2/2003 Thompson ..... A45D 34/04 222/386.5
2004/0226962 A1 * 11/2004 Mazursky ..... A47K 5/1217 222/95
2005/0098580 A1 * 5/2005 Ciavarella ..... A47K 5/1202 222/183
2009/0095774 A1 * 4/2009 Domoy ..... A45D 40/26 222/146.5
2009/0095775 A1 * 4/2009 Domoy ..... A45D 34/00 222/212
2009/0140004 A1 * 6/2009 Scorgie ..... A47K 5/1217 222/52
2009/0212071 A1 * 8/2009 Tom ..... B65B 31/003 222/95
2009/0224002 A1 * 9/2009 Bakhos ..... B65D 47/2018 222/209
2010/0147879 A1 * 6/2010 Ophardt ..... G01F 11/006 222/52
2011/0101029 A1 * 5/2011 Lewis, II ..... A47K 5/1202 222/153.03
2011/0240680 A1 * 10/2011 Ophardt ..... A47K 5/1207 222/321.8
2013/0206791 A1 * 8/2013 O'brien ..... B67D 7/84 222/105
2015/0083754 A1 * 3/2015 Proper ..... A47K 5/12 222/180
2015/0157176 A1 * 6/2015 Muderlak ..... A47K 5/1217 222/333

* cited by examiner

CLOSED SYSTEM FOR VENTING A DISPENSER RESERVOIR

RELATED APPLICATIONS

This patent application claims priority to patent application Ser. No. 61/968,058, titled CLOSED SYSTEM FOR VENTING A DISPENSER RESERVOIR, filed on Mar. 20, 2014, which is incorporated herein by reference in its entirety.

FIELD OF THE INVENTION

The current invention relates generally to fluid product dispensers and in particular to dispenser reservoirs. More specifically, the invention relates to ways of venting the reservoir during the dispensing process.

BACKGROUND OF THE INVENTION

It is known to dispense hand care products from a dispenser mounted to a wall, counter or dispenser stand. Dispensers may be conveniently located in building entrances, bathrooms, or lunchrooms providing convenient accessibility to passersby. Such dispensers may have a replaceable reservoir, also called a refill unit, containing hand soap, lotion or sanitizer. Replaceable reservoirs provide a sanitary solution to the problem found in refillable dispensers, which is that over time germ-laden bio-films form inside the fluid container and dispenser nozzle.

Replaceable reservoirs are often installed into dispensers in an inverted manner, which takes advantage of gravity to draw fluid out of the container. The reservoirs are connected to a pump, which pressurizes the fluid and meters out a predetermined amount of product. In many systems, the reservoirs are sealed from exposure to the atmosphere. As such, air cannot displace the fluid being pumped out of the reservoir thereby creating a vacuum inside the container. This makes it harder to draw fluid out of the reservoir and as such additional energy is needed to operate the pump. In systems using an onboard power supply this shortens the useful life of the power supply.

To overcome this problem, some reservoirs are constructed using thin gauge material. Thin-walled reservoirs are prone to collapse under atmospheric pressure as fluid is removed from the container. While the problem associated with vacuum pressure is somewhat alleviated, the thin gauge walls are susceptible to damage. Moreover, it is hard to read how much fluid is remaining in the refill reservoir because thin walls collapse unevenly and unpredictably.

Some systems vent ambient air directly into the refill reservoir to displace fluid dispensed from the system. While this relieves the vacuum pressure, it adds to the likelihood that germs, bacteria or other pathogens will be introduced into the system.

It would therefore be advantageous to use a rigid bottle that has side walls utilizing heavier gauge material if there was a way to vent the bottle without introducing contaminants into the replaceable reservoir. The embodiments of the current invention obviate the aforementioned problems.

SUMMARY OF THE INVENTION

In one embodiment of the subject invention, a dispensing system is provided that uses a replaceable reservoir for storing fluid product. The replaceable reservoir comes assembled with a pump and nozzle. The pump includes a vent that introduces air into the reservoir when fluid has been dispensed from the system. A bladder is connected to the inlet end of the pump assembly and positioned within the reservoir. Air vented into the reservoir is captured within the bladder and prevented from contacting the remaining fluid in the reservoir.

In one particular embodiment of the dispensing system, the bladder is generally oval or spherical is shape. In another embodiment, the bladder is shaped like a bellows or accordion.

In another embodiment of the subject invention, a refill unit for an associated dispensing system dispensing an associated liquid product includes: a reservoir defining an internal region for storing an associated liquid product, wherein the internal region is sealed from exposure to ambient air, wherein the reservoir includes an aperture through which the associated liquid product is operatively dispensed without exposing the internal region to ambient air; an air-tight variable volume bladder disposed within the internal region of the reservoir, the air-tight variable volume bladder defining an expandable bladder volume region that is sealed with respect to the internal region of the reservoir, wherein the air-tight variable volume bladder includes an inlet; and, wherein the reservoir includes an orifice open to ambient air and wherein the inlet of the air-tight variable volume bladder is connected to the orifice in a sealed manner to prevent exposure of the internal region of the reservoir to ambient air, and wherein the air-tight variable volume bladder expands when associated liquid product is operatively dispensed from the reservoir.

In one aspect of the embodiments of the subject invention, the refill unit also includes a check valve operatively connected to the aperture for allowing associated liquid product to flow from the reservoir, wherein the check valve inhibits ambient air from entering into the reservoir through the aperture.

In yet another aspect of the embodiments of the subject invention, the air-tight variable volume bladder is comprised of one or more walls constructed from pliable material.

In still another aspect of the embodiments of the subject invention, the air-tight variable volume bladder is comprised of one or more walls constructed from elastically deformable material.

In even another aspect of the embodiments of the subject invention, the air-tight variable volume bladder is comprised of one or more walls constructed from semi-rigid material separated by pleats that allow the one or more walls to fold and unfold thereby creating the expandable bladder volume region.

In still yet another aspect of the embodiments of the subject invention, vacuum pressure is generated within the internal region when associated liquid product is dispensed from the reservoir, and the air-tight variable volume bladder expands proportionally to the magnitude of vacuum pressure generated within the internal region.

In another embodiment of the subject invention, a refill unit for an associated dispensing system dispensing an associated liquid product includes: a reservoir defining a volumetric region for storing an associated liquid product, the reservoir including an aperture through which the associated liquid product is operatively dispensed; an expandable bladder constructed from pliable material, the expandable bladder being positioned within the volumetric region, wherein the expandable bladder is sealed in an air tight manner from the volumetric region of the reservoir, and wherein the expandable bladder includes a bladder inlet; a pump having a pump housing attached to the aperture of the reservoir in a sealed manner thereby preventing the volumetric region from exposure to ambient air, wherein the pump includes a pump inlet fluidly connected to the volumetric region for dispensing associated liquid product without exposing the volumetric region to ambient air; and wherein the pump housing includes an orifice having an orifice inlet exposed to ambient air and an orifice outlet connected in an air-tight manner to the bladder inlet.

In one aspect of the embodiments of the subject invention, the pump includes a check valve that allows associated fluid product into the pump and that prevents ambient air from entering the volumetric region.

In another aspect of the embodiments of the subject invention, the expandable bladder is constructed from elastically deformable material and wherein the expandable bladder is expandable from a first volume to a larger second volume when associated fluid product is pump from the reservoir; and the refill unit also includes a locking ring fixedly attaching the expandable bladder to the pump housing.

In yet another aspect of the embodiments of the subject invention, the pump housing includes an annular groove; and, wherein the locking ring compresses the material of the expandable bladder against the groove thereby creating an air tight seal.

In still another aspect of the embodiments of the subject invention, the expandable bladder is comprised of a plurality of walls constructed from semi rigid material, wherein the plurality of walls are separated by pleats that allow the plurality of walls to fold together in a first volume and that allow the plurality of walls unfold in a substantially larger second volume.

In even another aspect of the embodiments of the subject invention, the reservoir is constructed from semi-rigid material.

In another embodiment of the subject invention, a refill unit for an associated dispensing system dispensing an associated product, includes: a reservoir defining a volumetric region for storing an associated product, wherein the reservoir includes an aperture and an orifice; a pump attached to the aperture of the reservoir in a sealed manner, wherein the pump includes a pump inlet fluidly connected to the volumetric region; a variable volume bladder disposed within the volumetric region of the reservoir, wherein the variable volume bladder is sealed with respect to the volumetric region of the reservoir, wherein the variable volume bladder includes an inlet; and wherein the orifice is open to ambient air and wherein the inlet of the variable volume bladder is connected to the orifice of the reservoir in a sealed manner to prevent exposure of the internal region of the reservoir to ambient air.

In one aspect of the embodiments of the subject invention, the pump is a piston pump, which may include a check valve for allowing associated liquid product to dispense from the reservoir, wherein the check valve prevents ambient air from entering the volumetric region.

In another aspect of the embodiments of the subject invention, the reservoir is constructed from semi-rigid material.

In yet another aspect of the embodiments of the subject invention, the variable volume bladder is comprised of one or more walls constructed from pliable material.

In still another aspect of the embodiments of the subject invention, the variable volume bladder is comprised of one or more walls constructed from elastically deformable material.

In even another aspect of the embodiments of the subject invention, the variable volume bladder is comprised of one or more walls constructed from semi-rigid material separated by pleats that allow the one or more walls to fold and unfold thereby allowing the bladder to have a variable volume.

DETAILED DESCRIPTION

Figure 1:
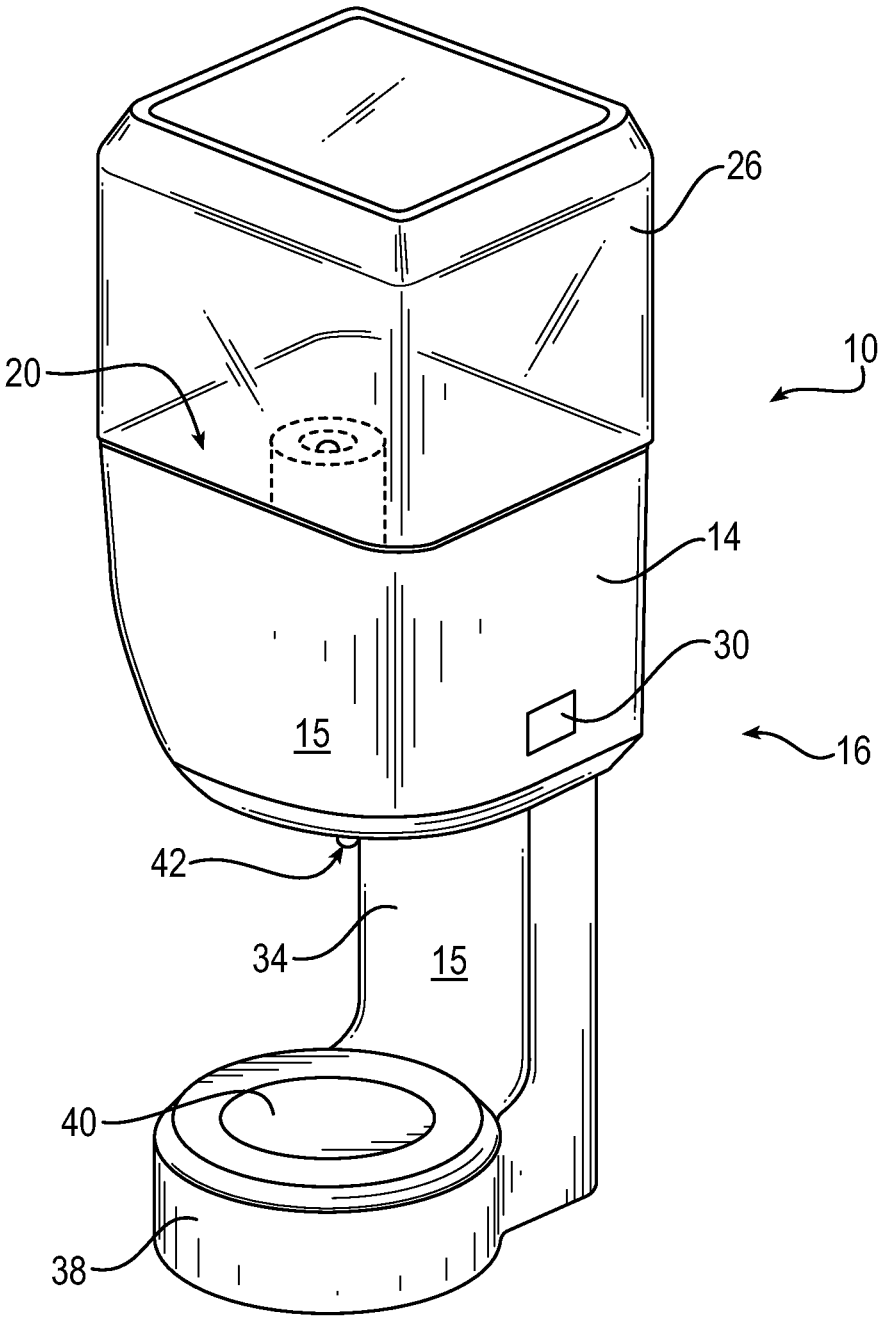
FIG. 1 depicts a fluid dispensing system according to the embodiments of the subject invention.

A product dispensing system is depicted in FIG. 1 that dispenses a measured amount of fluid product according to the embodiments of the subject invention. In one exemplary instance, the dispensing system, shown generally at 10, dispenses hand care products like soap, lotion or sanitizers, although other products may similarly be dispensed from the product dispenser.

In the embodiment depicted in FIG. 1, the dispensing system 10 includes a base 14. The base 14 is made of one or more walls 15 constructed to support the components of the dispensing system 10. Plastic may be used for cost effective manufacturing of the base 14, as well as other components of the system. A fluid reservoir 26 is mounted to the base in an inverted fashion and includes a pump for dispensing product in a manner known in the art. At a rear side 16 of the base 14, a mounting bracket is included for attaching the dispenser to a table, IV pole (Intravenous pole), dispenser stand or other supporting structure, none of which are shown in the figures. The mounting bracket may be modular in design, which is to say that the mounting bracket may be detached from the base 14 and replaced with another type of mounting bracket. In this way, the dispensing system may be selectively attached to different types of supporting structures.

As mentioned, the base 14 is designed to securely receive the fluid reservoir 26. The walls 15 of the base 14 may be constructed to form a concave region 20 at an upper end of the dispensing system 10. Structural components, not shown, receive and lock the reservoir 26 in place during use. A latch 30 is included to release the fluid reservoir when service is required.

Figure 2:
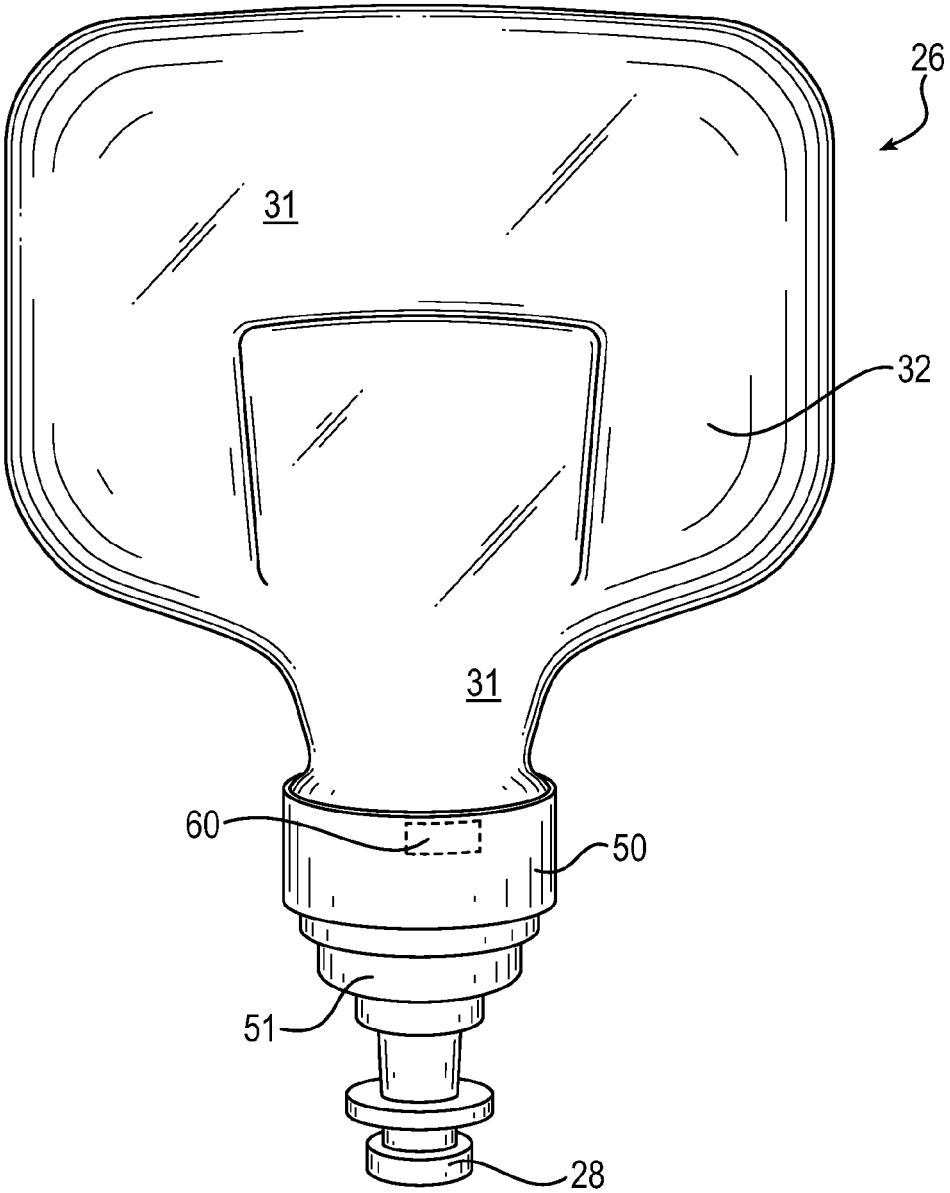
FIG. 2 depicts a replaceable refill unit of the dispensing system shown in FIG. 1, according to the embodiments of the subject invention.

Before installation into the base 14, the reservoir is fitted with a pump 51 (shown in FIG. 2). The pump is engaged by an assembly of linkages and driven by a motor, not shown, for actuating the pump and dispensing the product. Batteries may be stored onboard the dispensing system 10 to provide power for actuating the motor. For dispersing fluid product in a desired manner, a nozzle 28 is attached to an outlet of the pump.

With continued reference to FIG. 1, the base 14 may include a spine 34 or back plate 34 extending downwardly from the base 14. In one embodiment, the spine 34 is integrally fashioned with the base 14. However, other embodiments are contemplated where the spine 34 may be fastened to the base 14. A drip plate 38 extends from the distal end of the spine 34 and protrudes outward at an angle of approximately 90 degrees, although any acute angle may be chosen. The drip plate 38 is thus positioned at an elevation beneath the pump, and more specifically beneath the nozzle. Persons of skill in the art will understand that the drip plate 38 will capture residual product that may drip from the nozzle during or after use. Accordingly, the drip plate 38 may be constructed with a concave center 40 to catch fluid product until it evaporates or is cleaned by service personnel.

In one embodiment, the batteries (not shown) may be housed in the body of the drip plate 38. Conductors (also not shown) may be routed from the battery cavity up to the motor located in the base 14. It follows that the conductors run to the motor through the spine 34. In other embodiments, electronic circuitry, e.g. circuit boards, used by the dispensing system 10 may also be housed in the base 14 or spine 34. It is expressly noted here that other configurations of dispenser housing may be employed that do not include a spine 34 or drip plate 38. In these embodiments, the control circuitry as well as the batteries may be housed in the base 14. All such variations are to be construed as falling within the scope of coverage of the embodiments of the subject invention.

Still referencing FIG. 1, the product dispensing system 10 may be activated without touching the base 14 or any component of the system. Accordingly, the "touch-free" system may include one or more sensors 42 that detect motion beneath the nozzle. In one exemplary embodiment, the sensors 42 use IR (infrared) technology, which may be installed on an underside of the base 14. To avoid accidental activation, the sensor's field of detection may be particularly oriented to detect motion only within a specific region between the base 14 and the drip plate 38. Other types of sensors and/or configurations of sensors may be chosen without departing from the intended scope of coverage of the embodiments of the subject invention.

Other modes of operation are considered where the dispensing system 10 is manually activated. A push-bar or lever (not shown in the figures), may be moveably connected to the base 14 of the dispensing system 10. In one particular embodiment, the push-bar may pivot to directly contact the actuating components of the pump 51. Alternatively, the push-bar may translate to engage a linkage that actuates the pump 51. In operation, the user physically depresses the push-bar. Force from the user's hand is translated to actuate the pump 51. Accordingly, the need for a motor or other electrically powered actuator is eliminated, as well as the need for motion sensors.

With reference now to FIG. 2, the fluid reservoir 26 is generally enclosed for storing a predetermined quantity of fluid product in a reservoir area 32. An aperture is included through which fluid egresses from the reservoir 26. The aperture may protrude outwardly from an end of the fluid reservoir 26 and may comprise externally fashioned threads 46, shown in FIG. 4, designed to receive and hold a cap 50 in place once assembled. It follows that the cap 50 includes matching threads 52 that interconnect with threads 46. In one particular embodiment, the reservoir 26 may be constructed via a blow-molding process, although other thermoforming processes may be used as chosen with sound judgment as known by persons of ordinary skill in the art. The reservoir 26, which may be a replaceable refill reservoir, can be constructed from rigid or semi-rigid polymeric material, as discussed below. Accordingly, as fluid product flows out of the reservoir 26, the walls 31 of the container will substantially maintain its original shape.

Figure 3:
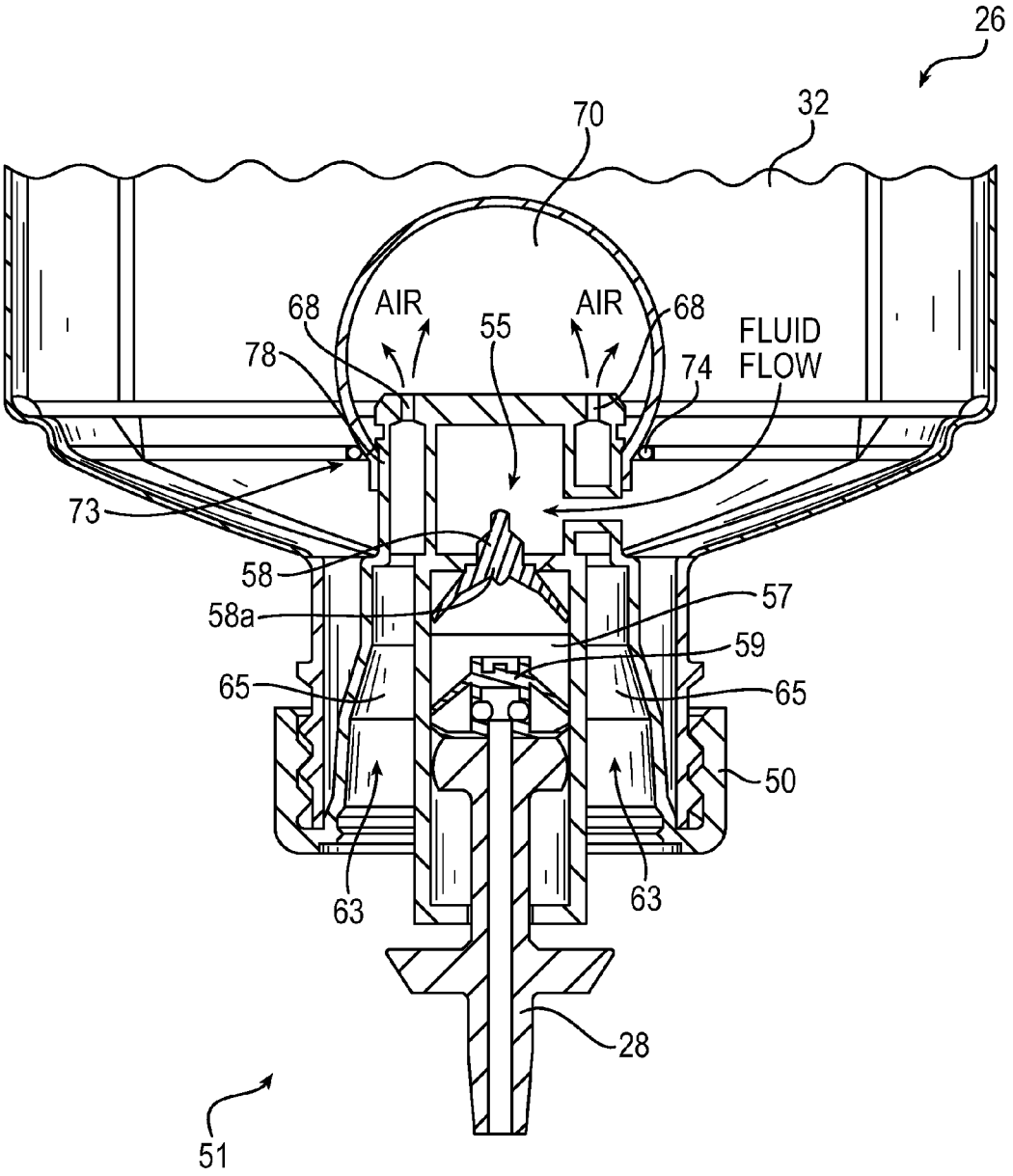
FIG. 3 is a close-up, partial cross sectional view of the pump and refill unit of the dispensing system shown in FIGS. 1 and 2, according to the embodiments of the subject invention.

With continued reference to FIG. 2 and now also to FIG. 3, the pump 51, as introduced above, fluidly connects to the aperture of the fluid reservoir 26. By fluidly connects it is meant that the inlet 55 of the pump 51 is positioned to receive fluid product stored in the reservoir area 32. As such, the pump 51 is juxtaposed to the aperture or extends through the aperture into the fluid reservoir 26 and may be secured in place by the cap 50. In one particular embodiment, the pump 51 comprises a pump chamber 57. At one end of the pump chamber 57, a valve 58 is positioned to allow fluid flow in only one direction, namely from the reservoir area 32 into the pump chamber 57. The valve 58 may comprise a check valve 58*a*. At the distal end of the pump chamber 57, another valve 59 is included that similarly allows fluid flow in only one direction, and which connects to the nozzle 28. A piston reciprocates within the pump chamber 57 in first and second directions. The piston is sealed within the pump chamber 57 so that fluid product enters and exits only through the valves 58, 59. Skilled artisans will understand that when the piston is moved in a first direction, fluid is drawn into the pump chamber 57 from the reservoir area 32 because of negative vacuum pressure created by displacement of the piston. Conversely, movement of the piston in the second direction will pressurize the fluid and force it out of the chamber 57 through the nozzle 28. Of course, fluid is prevented from flowing back into the reservoir area 32 because of valve 58. No further explanation about the construction and operation of the pump will be offered at this time.

It is expressly noted here that the pump 51 may be integrally fashioned with the cap 50. However, alternative embodiments are contemplated where the pump 51 comprises a separate component that installs with the cap 50 onto the fluid reservoir 26. In either case, once securely installed, a fluid tight connection is made between the aperture of the fluid reservoir 26 and the pump/cap assembly.

With continued reference to FIG. 2, a validation key 60 or tag may be implemented between fluid reservoir 26 and dispensing system 10 for validating the contents of the fluid reservoir 26. In one particular embodiment, the cap 50 includes the validation key 60. The key 60 may comprise an RFID (Radio Frequency Identification) tag, which may be either passive or active. A corresponding interrogator, not shown, may be mounted within the base 14. Accordingly, when the fluid reservoir 26 is installed onto the base 14, the interrogator will automatically "ping" the electronic key 60 to verify that the correct fluid reservoir 26 is being used. If an incorrect fluid reservoir is installed, a control system will disable operation of the dispenser 10. Alternative types of validation keys are contemplated where the cap 50 includes an electrically conductive coil, not shown in the figures. The coil may be constructed having a predetermined impedance or electrical signature. When the fluid reservoir 26 is installed onto the base 14, the coil is communicated with the controller which may sense or measure the impedance for use in validating the fluid reservoir 26. Skilled artisans will appreciate that other locations for and other forms of validating keys 60 may be used, like for example keyed mechanical fittings or optical sensor systems. Still, any manner of ensuring that the dispensing system 10 works only with an authorized fluid reservoir 26 may be chosen as is consistent with the subject invention described herein.

Referring again to FIG. 3, the fluid reservoir 26 may include one or more air passageways 63 that allow ambient air to enter a region within the reservoir area 32. In one particular embodiment, the air passageways 63 may be incorporated into the structure encasing the pump 51 and/or cap 50. More specifically, the air passageways 63 comprise channels 65 that run adjacent to the pump chamber 57. The channels 65 terminate at orifices 68, which connect the channels 65 to the internal region within the reservoir area 32. The quantity and cross-sectional configuration of orifices 68 may vary as is needed for allowing a particular volume of ambient air to flow into the internal region of the reservoir area 32 as is appropriate for use with a particular output capacity of pump 51. Notably, the orifices 68 have a smaller cross-sectional area than the channels 65. However, any suitable ratio of cross-sectional areas of the orifices and the channels may be selected. While the embodiments described herein relate to air passageways formed within the structure of the pump and/or reservoir cap, it is to be understood that air passageways 63 may be incorporated into other portions of the fluid reservoir like for example, but not limited to, the walls 31 of the reservoir 26.

A membrane or bladder 70 is connected that surrounds and isolates the orifices 68 from direct contact with the fluid contained in a reservoir area 32. As such, fluid contained in the reservoir 26 cannot egress or leak through the orifices 68. Moreover, air flowing into internal region of the reservoir area 32 (as will be described further below) is prevented from contacting the fluid product thereby maintaining the sanitary seal of the fluid reservoir 26.

The bladder 70 may be constructed from pliable material, which can collapse upon itself or expand when air, i.e. air pressure or atmospheric air, is introduced into the bladder. In one embodiment, the bladder 70 is constructed from polymeric material, which may be a thermoplastic polymer. More specifically, the material comprising the bladder 70 may be comprised of a thermoset material. However any type of material that allows the bladder 70 to adjust its volume may be used as is consistent with the embodiments described herein.

The bladder material may have a relatively high elasticity. A bladder 70 constructed from this type of material stretches to expand when air is introduced into its interior and contracts to its original shape when air is relieved from the system. It will be realized that elastomeric material exerts an element of pressure on the air contained within the bladder 70 which is in addition to the pressure exerted by the amount of fluid remaining in the reservoir 26.

In an alternative embodiment, the bladder 70 may be constructed from pliable material having a relatively low elasticity. In this instance, the walls of the bladder 70 do not substantially stretch when filled with air but rather just unfurl or straighten out. Absent air in the bladder 70, the walls simply fold upon themselves. In this instance, the walls of the bladder 70 expand and retract only as a function of the head pressure within the reservoir area 32. Still, with either type of material the volume of the bladder changes in response to the amount of fluid remaining in the reservoir area 32.

Still focusing on FIG. 3, the bladder 70 may be curved having a spherical or oval cross-sectional configuration. Additionally, the bladder 70 may include an opening at an end portion thereof. From the aforementioned, it will be readily seen that the opening of the bladder may be configured to cover that portion of the structure containing the orifices 68. In order to receive and hold the bladder 70 in place, the structure containing the orifices 68, hereafter referred to as the bladder receiving portion 78, may include a raised lip or recessed groove onto which the peripheral edge of the opening of the bladder 70 may be installed. A clamping mechanism 73 applied to the interface of the bladder and the underlying rigid structure ensures a fluid tight seal there between. In one embodiment, the clamping mechanism 73 may comprise a locking ring 74. In other embodiments, the clamping mechanism 73 may comprise an elastic band, not shown. However, other means of securing the bladder 70 to the structure containing the orifices 68 may be selected without departing from the intended scope of coverage of the embodiments of the subject invention.

It is noted here that other configurations of the bladder receiving portion 78 may be employed without limiting the scope of the claimed invention. Other embodiments may comprise a bladder receiving portion 78 that has a substantially smooth outer surface or alternatively a rippled or an uneven outer surface. Still other embodiments are contemplated where the opening of the bladder 70 is positioned and secured to an inner or recessed surface of the bladder receiving portion 78.

In one method of assembling the fluid reservoir 26, the bladder 70 may be initially installed onto the bladder receiving portion 78 of the pump 51 and cap 50. In one embodiment, the orifices 68 are disposed at a distal end of the pump 51. As such, bladder 70 may be juxtaposed to the distal end of the pump 51 and secured thereto by way of the clamping mechanism 73. Separately, the reservoir 26 may be filled with fluid product. Once the bladder 70 has been installed and the reservoir has been filled, the pump/bladder assembly may be inserted into the reservoir area 32, where the entire assembly is secured in place by the cap 50 or by other means chosen with the sound judgment of persons of skill in the art.

Skilled artisans will readily see that as the pump 51 is actuated, fluid product will be dispensed through the nozzle 28 and as a result vacuum pressure within the walls of the reservoir 26 will increase. As vacuum pressure increases, ambient air will automatically flow into the bladder 70 expanding its volume thereby equalizing the pressure within the reservoir 26. Consequently, less energy will be needed to actuate the pump 51, which maximizes the useful life of the batteries.

Figure 4:
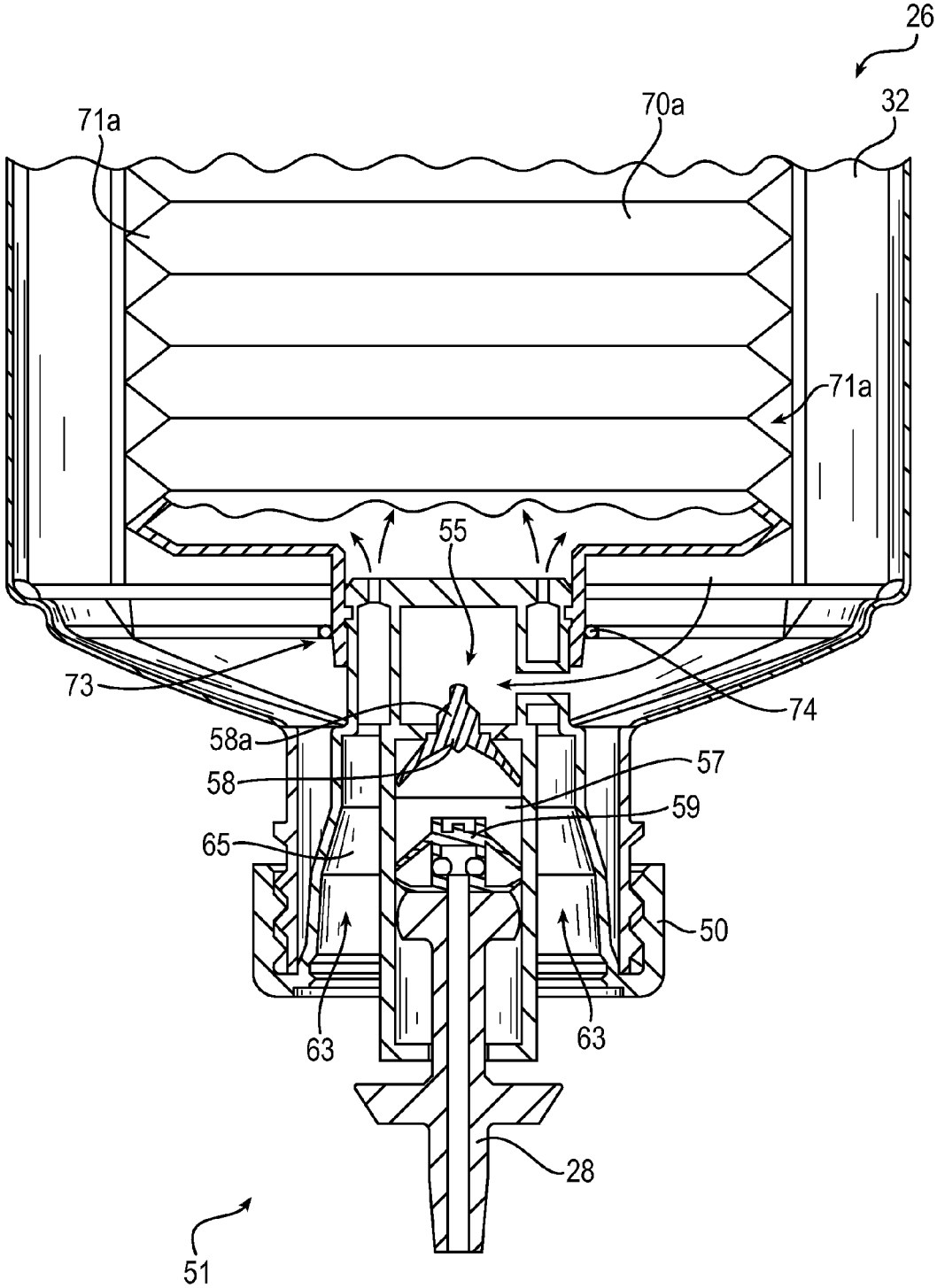
FIG. 4 is a partial cross sectional view of the pump and refill unit showing another embodiment of the subject invention.

With reference now to FIG. 4, an alternative configuration of the bladder will now be described. In this embodiment, bladder **70*a* is shown and described herein as having side walls that expand and collapse in a predefined manner. Specifically, the side walls of the bladder 70*a* include pleats 71*a* that cause the height of the bladder to expand and retract uniformly. Accordingly, the bladder 70*a* can be constructed from any material suitable for forming the pleats 71*a*. When ambient air is drawn into the interior of the bladder 70*a* (in response to fluid product being pumped from the reservoir area), the height of the bladder 70*a* will change, i.e. increase, but the circumference of the bladder will remain substantially the same. In this manner, fluid product will be displaced uniformly near the walls of the reservoir 26 making it easier to see how much fluid is remaining in the reservoir 26**. Still, other configurations for the bladder that uniformly displaced fluid product may be employed. All such variations are to be construed as falling within the scope of coverage of the embodiments of the subject invention.

Figure 5:
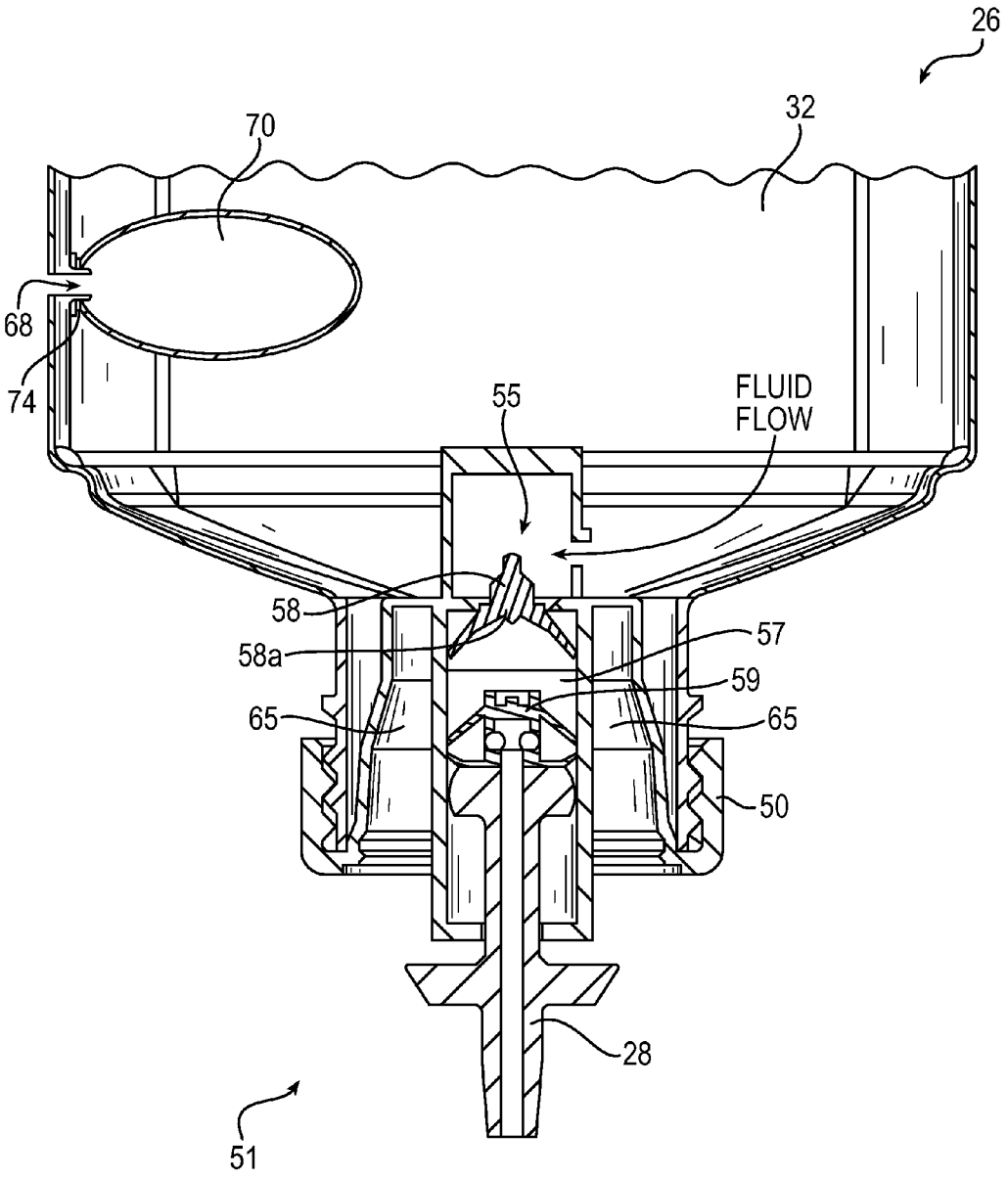
FIG. 5 is a partial cross sectional view showing yet another embodiment of the pump, reservoir and bladder, according to the embodiments of the subject invention.

With reference now to FIG. 5, it is noteworthy to mention that the bladder 70, **70*a* and orifice 63 may be separated from the pump. While the embodiments shown thus far depict the bladder 70, 70*a* and orifices 68 incorporated into the pump or pump housing, the bladder 70, 70***a* and orifices 68 may be incorporated into another portion of the reservoir 26. FIG. 5 shows one exemplary configuration of an orifice 68 fashioned in a side portion, i.e. side wall, of the reservoir 26. A lip may be formed internally around the orifice 68, onto which the inlet of the bladder 70, 70*a* may be fixedly attached via locking ring 74 or by other means. Alternatively, the bladder 70, 70*a* and orifice(s) 68 may be distally positioned opposite to the location of the pump 51. However, it is to be construed that the bladder 70, 70*a* and corresponding orifice(s) 68 may be disposed anywhere within the reservoir as is appropriate for use to vent the reservoir 26.

The dispensing system 10 may further include a control system (mentioned above) comprising one or more electronic circuits, not shown, for controlling the operation of the dispensing system 10. The electronic circuitry may reside on a printed circuit board and received in a suitable enclosure, not shown. Energy may be supply from the batteries to power the control system. In one embodiment, digital electronic circuitry is included in the control system, which functions to output signals used to control operation of various components of the dispensing system 10, like for example operation of the motor, not shown. The digital electronic circuitry may also function to receive input signals from the electronic validation key 60 and onboard sensors 42. During maintenance of the dispenser 10, service personnel may detach the existing fluid reservoir 26 from the base 14 and replace it with a new sanitary fluid reservoir. Once installed, the control system will check the signal received by the interrogator to ensure that the correct refill unit has been installed. Upon verification, the control system will enable the motor to actuate the pump 51 when activated by the user.

Having illustrated and described the principles of the dispensing system in one or more embodiments, it should be readily apparent to those skilled in the art that the invention can be modified in arrangement and detail without departing from such principles.

It is claimed:

1. A refill unit for an associated dispensing system dispensing an associated liquid product, comprising:

a reservoir defining an internal region for storing an associated liquid product, wherein the internal region is sealed from exposure to ambient air, wherein the reservoir includes an aperture through which the associated liquid product is operatively dispensed without exposing the internal region to ambient air;

an air-tight variable volume bladder disposed within the internal region of the reservoir, the air-tight variable volume bladder defining an expandable bladder volume region that is sealed with respect to the internal region of the reservoir, wherein the air-tight variable volume bladder includes an inlet;

a pump configured to dispense the associated liquid product stored in the internal region of the reservoir, the pump having a pump housing attached to the aperture of the reservoir in a sealed manner thereby preventing the internal region from exposure to ambient air, wherein the pump includes a pump inlet fluidly connected to the internal region such that the pump dispenses the associated liquid product without exposing the internal region to ambient air, and wherein the pump housing includes an orifice open to ambient air;

wherein the inlet of the air-tight variable volume bladder is connected to the orifice of the pump housing in a sealed manner to prevent exposure of the internal region of the reservoir to ambient air.

2. The refill unit as defined in claim 1, further comprising:

a check valve operatively connected to the aperture for allowing associated liquid product to flow from the reservoir, wherein the check valve inhibits ambient air from entering into the reservoir through the aperture.

3. The refill unit as defined in claim 1, wherein the air-tight variable volume bladder is comprised of one or more walls constructed from pliable material.

4. The refill unit as defined in claim 3, wherein the air-tight variable volume bladder is comprised of one or more walls constructed from elastically deformable material.

5. The refill unit as defined in claim 1, wherein the air-tight variable volume bladder is comprised of one or more walls constructed from semi-rigid material separated by pleats that allow the one or more walls to fold and unfold thereby creating the expandable bladder volume region.

6. The refill unit as defined in claim 5, wherein vacuum pressure is generated within the internal region when associated liquid product is dispensed from the reservoir, and wherein the air-tight variable volume bladder expands proportionally to the magnitude of vacuum pressure generated within the internal region.

7. A refill unit for an associated dispensing system dispensing an associated liquid product, comprising:

a reservoir defining a volumetric region for storing an associated liquid product, the reservoir including an aperture through which the associated liquid product is operatively dispensed;

an expandable bladder, the expandable bladder being positioned within the volumetric region, wherein the expandable bladder is sealed in an air tight manner from the volumetric region of the reservoir, and wherein the expandable bladder includes a bladder inlet;

a pump configured to dispense the associated liquid product stored in the volumetric region of the reservoir, the pump having a pump housing attached to the aperture of the reservoir in a sealed manner thereby preventing the volumetric region from exposure to ambient air, wherein the pump includes a pump inlet fluidly connected to the volumetric region such that the pump dispenses the associated liquid product without exposing the volumetric region to ambient air, and wherein the pump housing includes an orifice having an orifice inlet exposed to ambient air and an orifice outlet connected in an air-tight manner to the bladder inlet.

8. The refill unit as defined in claim 7, wherein the pump includes a check valve that allows associated fluid product into the pump and that prevents ambient air from entering the volumetric region.

9. The refill unit as defined in claim 7, wherein the expandable bladder is constructed from elastically deformable material and wherein the expandable bladder is expandable from a first volume to a larger second volume when associated fluid product is pump from the reservoir; and further comprising:

a locking ring fixedly attaching the expandable bladder to the pump housing.

10. The refill unit as defined in claim 9, wherein the pump housing includes an annular groove; and, wherein the locking ring compresses the material of the expandable bladder against the groove thereby creating an air tight seal.

11. The refill unit as defined in claim 10, wherein the expandable bladder is comprised of a plurality of walls constructed from semi rigid material, wherein the plurality of walls are separated by pleats that allow the plurality of walls to fold together in a first volume and that allow the plurality of walls unfold in a substantially larger second volume.

12. The refill unit as defined in claim 7, wherein the reservoir is constructed from semi-rigid material.

13. A refill unit for an associated dispensing system dispensing an associated product, comprising:

a reservoir defining a volumetric region for storing an associated product, wherein the reservoir includes an aperture;

a pump having a pump housing, the pump housing attached to the aperture of the reservoir in a sealed manner thereby preventing the volumetric region from exposure to ambient air, wherein the pump includes a pump inlet fluidly connected to the volumetric region such that the pump dispenses the associated product without exposing the volumetric region to ambient air, and wherein the pump housing includes an orifice;

a variable volume bladder disposed within the volumetric region of the reservoir, wherein the variable volume bladder is sealed with respect to the volumetric region of the reservoir, wherein the variable volume bladder includes an inlet; and, wherein the orifice of the pump housing is open to ambient air, and wherein the inlet of the variable volume bladder is connected to the orifice in a sealed manner to prevent exposure of the volumetric region of the reservoir to ambient air.

14. The refill unit as defined in claim 13, wherein the pump is a piston pump.

15. The refill unit as defined in claim 13, wherein the pump includes a check valve for allowing associated liquid product to dispense from the reservoir, and wherein the check valve prevents ambient air from entering the volumetric region.

16. The refill unit as defined in claim 13, wherein the reservoir is constructed from semi-rigid material.

17. The refill unit as defined in claim 13, wherein the variable volume bladder is comprised of one or more walls constructed from pliable material.

18. The refill unit as defined in claim 17, wherein the variable volume bladder is comprised of one or more walls constructed from elastically deformable material.

19. The refill unit as defined in claim 13, wherein the variable volume bladder is comprised of one or more walls constructed from semi-rigid material separated by pleats that allow the one or more walls to fold and unfold thereby allowing the bladder to have a variable volume.

20. The refill unit as defined in claim 13, further comprising:

a locking ring for affixing the variable volume bladder to the reservoir.

* * * * *